US009234718B2

(12) United States Patent
Ricke

(10) Patent No.: US 9,234,718 B2
(45) Date of Patent: Jan. 12, 2016

(54) PROJECTILE LAUNCHING SYSTEM

(71) Applicant: Levi N. Ricke, Loveland, CO (US)

(72) Inventor: Levi N. Ricke, Loveland, CO (US)

( * ) Notice: Subject to any disclaimer, the term of this patent is extended or adjusted under 35 U.S.C. 154(b) by 62 days.

(21) Appl. No.: 14/081,904

(22) Filed: Nov. 15, 2013

(65) Prior Publication Data

US 2015/0136102 A1 May 21, 2015

(51) Int. Cl.

| | |
|---|---|
| ***F41B 3/00*** | (2006.01) |
| ***F41B 3/02*** | (2006.01) |
| ***A63B 65/00*** | (2006.01) |
| ***A63B 69/40*** | (2006.01) |

(52) U.S. Cl.

CPC . *F41B 3/02* (2013.01); *A63B 65/00* (2013.01); *A63B 69/40* (2013.01); *F41B 3/005* (2013.01)

(58) Field of Classification Search

CPC ..... F41B 3/02; F41B 3/005; A63B 69/40; A63B 65/00

USPC ..... 124/16, 17, 20.1, 20.3, 22, 80

See application file for complete search history.

(56) References Cited

U.S. PATENT DOCUMENTS

| | | | | | |
|---|---|---|---|---|---|
| 1,153,415 | A * | 9/1915 | Beaty | F41B 5/14 | 124/1 |
| 2,324,201 | A * | 7/1943 | Donaldson | F41B 3/02 | 124/16 |
| 2,715,895 | A * | 8/1955 | Loveless | F41B 3/02 | 124/20.3 |
| 2,820,444 | A * | 1/1958 | Pedersen | F41B 3/02 | 124/20.1 |
| 2,970,839 | A * | 2/1961 | Halverson | F41B 3/02 | 43/6 |
| 2,995,129 | A * | 8/1961 | Malott | F41B 3/02 | 124/20.1 |
| 3,108,583 | A * | 10/1963 | Andis | F41B 5/12 | 124/20.1 |
| 3,306,278 | A * | 2/1967 | Spatari | F41B 5/0094 | 124/20.2 |
| 3,494,346 | A * | 2/1970 | Yount | F41B 3/02 | 124/20.1 |
| 3,614,947 | A * | 10/1971 | Feldman | F41B 3/02 | 124/20.3 |
| 3,923,034 | A * | 12/1975 | Wolf | F41B 3/02 | 124/20.1 |
| 3,949,729 | A * | 4/1976 | Pfotenhauer | F41B 5/12 | 124/20.1 |
| 3,974,820 | A * | 8/1976 | Ott | F41B 3/02 | 124/20.1 |
| 3,983,860 | A * | 10/1976 | Bolton | F41B 3/02 | 124/20.1 |
| 4,050,438 | A * | 9/1977 | Pfotenhauer | F41B 3/02 | 124/20.1 |
| 4,169,453 | A * | 10/1979 | Hunsicker | F41B 3/02 | 124/16 |
| 4,265,212 | A * | 5/1981 | Wolf | F41B 3/02 | 124/20.1 |

(Continued)

OTHER PUBLICATIONS

Theslingshotforum. Come Add your Slingshot to our Registry! Website, http://www.theslingshotforum.com, downloaded Mar. 12, 2014, 5 total pages.

(Continued)

*Primary Examiner* — Alexander Niconovich

(74) *Attorney, Agent, or Firm* — Craig R. Miles; CR Miles, P.C.

(57) ABSTRACT

A projectile launcher having a pair of band securement elements each configured to secure the ends of a band and a pair of members disposed a distance from the pair of securement elements and located to permit the band to wrap about each of the pair of members passing the medial portion of the band between the pair of members to stretch the band toward the drawn condition of the projectile launcher.

12 Claims, 10 Drawing Sheets

(56) References Cited

U.S. PATENT DOCUMENTS 4,332,230 A * 6/1982 Lozier ..... F41B 3/02 124/16
4,411,248 A * 10/1983 Kivenson ..... F41B 3/02 124/20.1
4,458,658 A * 7/1984 Blair ..... F41B 3/02 124/20.1
4,703,744 A * 11/1987 Taylor ..... F41B 3/02 124/20.1
4,722,316 A * 2/1988 Stinnett ..... F41B 3/02 124/16
4,873,964 A * 10/1989 Bonoan ..... A63B 65/12 124/20.1
4,877,007 A * 10/1989 Olson ..... F41B 3/02 124/20.3
5,072,715 A * 12/1991 Barr ..... F41B 5/0026 124/17
5,123,643 A * 6/1992 Heilhecker ..... A63B 69/407 124/21
5,154,515 A * 10/1992 Haynes ..... F41B 3/02 124/17
5,230,323 A * 7/1993 Saunders ..... F41B 3/02 124/17
5,243,955 A * 9/1993 Farless ..... F41B 3/005 124/20.1
5,279,276 A * 1/1994 Nagel ..... F41B 3/02 124/20.1
5,345,922 A * 9/1994 Ott ..... F41B 3/02 124/16
D352,086 S * 11/1994 Ott ..... F41B 3/02 D22/106
5,431,145 A * 7/1995 Strait ..... A63B 65/122 124/17
5,501,207 A * 3/1996 Black ..... F41B 3/02 124/20.1
5,531,209 A * 7/1996 Liedtke ..... F41B 3/02 124/20.1
5,551,412 A * 9/1996 Warnke ..... F41B 3/005 124/20.1
5,579,750 A * 12/1996 Lease ..... F41B 3/02 124/20.1
5,642,723 A * 7/1997 Hogan ..... F41B 7/003 124/20.3
5,671,722 A * 9/1997 Moody ..... F41B 7/00 124/17
5,673,677 A * 10/1997 Wing ..... F41B 5/0094 124/17
5,694,913 A * 12/1997 Parrott ..... F41B 3/02 124/17
5,752,495 A * 5/1998 Tuller ..... F41B 3/02 124/20.2
5,762,056 A * 6/1998 Kysilka ..... F41B 3/02 124/20.1
5,803,067 A * 9/1998 Ellenburg ..... F41B 3/02 124/20.1
5,894,672 A * 4/1999 Ellenburg ..... F41G 1/32 124/20.1
6,564,787 B1 * 5/2003 Barry ..... F41G 1/35 124/20.1
6,786,213 B1 * 9/2004 Lee ..... F41B 3/02 124/20.1
6,823,855 B2 * 11/2004 Omi ..... F41B 3/02 124/20.1
6,884,188 B2 * 4/2005 Cherry ..... A63B 69/407 124/17
6,968,835 B2 * 11/2005 Lee ..... F41B 3/02 124/20.1
7,168,424 B1 * 1/2007 Wing ..... F41B 3/02 124/20.1
7,389,774 B1 * 6/2008 Fonda ..... F41B 3/02 124/20.1
7,392,801 B2 * 7/2008 McCallister ..... A63B 21/0552 124/17
7,484,505 B1 * 2/2009 Saunders ..... F41B 3/02 124/20.1
7,827,977 B2 11/2010 Saunders
8,025,047 B2 9/2011 Saunders
8,347,868 B2 1/2013 Saunders
8,453,630 B2 * 6/2013 Fields ..... F41B 7/00 124/20.3
8,567,376 B2 * 10/2013 Flint ..... F41B 5/12 124/20.3
8,640,682 B2 * 2/2014 Shirk, II ..... F41G 11/001 124/20.1
8,662,060 B2 * 3/2014 Walterscheid ..... F41B 5/12 124/20.3
2003/0056775 A1 * 3/2003 Omi ..... 124/20.1
2006/0191521 A1 * 8/2006 Gee ..... A63B 65/122 124/20.1
2012/0037137 A1 * 2/2012 Thurmon ..... F41B 3/02 124/20.3
2012/0085330 A1 * 4/2012 Hickerson ..... A01K 81/04 124/22
2014/0290635 A1 * 10/2014 Saunders ..... F41B 3/02 124/17

OTHER PUBLICATIONS

Aliexpress. 1PCS Camping Outdoor Hunting King Slingshot . . . On-line Catalog, http://www.aliexpress.com, originally downloaded Sep. 25, 2013, 7 total pages.
Aliexpress.Dual-Use Slingshot Anti-skidding Roughness Design Handle Hunter Sling Shot Catapult . . . On-line Catalog,http://www.aliexpress.com,orig.downloaded Sep. 14, 2013,7 total pgs.
Aliexpress. Eagle of Sniper Slingshot Hunter Camouflage color Catapult with Arrow Rest . . . On-line Catalog, http://www.aliexpress.com, originally downloaded Sep. 23, 2013, 1 page.
Aliexpress. Eagle of Sniper Slingshot Hunter Catapult with Arrow Rest . . . On-line Catalog, http://www.aliexpress.com, originally downloaded Sep. 14, 2013, 8 total pages.
Aliexpress. Powerful Crazy Fox Slingshot Stainless Steel Sling Shot Outdoor Hunting Pro Catapult . . . On-line Catalog, http://www.aliexpress.com, orig.downloaded Sep. 14, 2013,7 pages.
Aliexpress. Steel Powerful Wrist Brace Support Shot Slingshot Catapult Hunting High 2 Band.On-line Catalog, http://www.aliexpress.com,orig.downloaded Sep. 14, 2013,6 total pgs.
Dhgate.com. Cool!! W/Cartridge Semi-automatic Reload System Falcon Style Sport Hunting Catapult Sling Slingshot. On-line Catalog, http://www.dhgate.com, originally downloaded Sep. 14, 2013, 6 total pages.
Lovesaction.com. Aluminum Alloy Solid Classic Antislip Ergonomic Slingshot. On-line Catalog, http://gifts.lovesaction.com, originally downloaded Sep. 14, 2013, 6 total pages.
Slingshot Shooting. Slingshots of the World: Hunting Slingshot. Website, http://slingshot-shooting.de, originally downloaded Oct. 25, 2013, 2 total pages.

* cited by examiner 1
3
3/5/6/11
4
14
15/16
19/25
20
21
24
26
31
32
33/35
33/36
34
40
45
46
48
49
52
53
58
59
64

1/18

PROJECTILE LAUNCHING SYSTEM

I. FIELD OF THE INVENTION

A projectile launcher having a pair of band securement elements each configured to secure the ends of a band and a pair of members disposed a distance from the pair of securement elements and located to permit the band to wrap about each of the pair of members passing the medial portion of the band between the pair of members to stretch the band toward the drawn condition of the projectile launcher.

II. BACKGROUND OF THE INVENTION

The basic configuration and mechanics of slingshots have remained substantially constant over time. Conventional slingshots comprise a handle and a pair of arms extending divergently upward from the handle. The ends of an elastic band couple to the arms. A pouch designed to hold a projectile is coupled at the center of the elastic band. The pouch containing a projectile can be pulled away from the arms and stretching the elastic band. The pouch upon release allows the elastic bands to return toward the original unstretched condition releasing the potential energy of the elastic band as kinetic energy which transfers to the projectile through the pouch. The projectile is launched out of the pouch as the elastic band returns to the original unstretched condition.

III. SUMMARY OF THE INVENTION

A broad object of particular embodiments of the invention can be to provide a projectile launcher having a pair of band securement elements each configured to secure the ends of a band and a pair of members disposed a distance from the pair of securement elements and located to permit the band to wrap about each of the pair of members to pass the medial portion of the band between the pair of members to stretch the band toward the drawn condition of the projectile launcher. Upon release of the band in the stretched condition, the band returns toward the unstretched condition passing between and unwrapping from the pair of members. This configuration of the projectile launcher affords the advantage of reducing or avoiding the necessity of folding or disposing the band external surface in an adjacent overlying relation proximate the pair of band securement elements as the band passes between the pair of members which can increase and make more uniform conversion of the potential energy of the band to kinetic energy and subsequent transfer of the kinetic energy to the projectile.

Another broad object of particular embodiments of the invention can be to provide a projectile launcher having a pair of band securement elements each configured to secure the ends of a band and a pair of members disposed a distance from the pair of securement elements and located to permit the band to wrap about each of the pair of members to pass the medial portion of the band between the pair of members which allows a substantial increase in the band length without substantially altering the draw length of the band. This configuration of the projectile launcher can afford the advantage of increasing the amount of potential energy which can be stored in the band and which can be converted to kinetic energy to propel the projectile, and thereby the speed of the projectile released from the pouch of the projectile launcher can be increased.

Another broad object of particular embodiments of the invention can be to provide a provide a projectile launcher having a pair of band securement elements each configured to secure the ends of a band and a pair of members disposed a distance from the pair of securement elements and located to permit the band to wrap about each of the pair of members and pass the medial portion of the band between the pair of members in which the distance between the pair of band securement elements and the pair of members about which the band wraps can be adjusted by movement of either the pair of band securement elements or the pair of members or both. This configuration of the projectile launcher can afford the advantage of allowing adjustment of the length of the medial portion of the band which passes between the pair of members.

Another broad object of particular embodiments of the invention can be to provide a projectile launcher having a pair of band securement elements each configured to secure the ends of a band and a pair of members disposed a distance from the pair of securement elements and located to permit the band to wrap about each of the pair of members and pass the medial portion of the band between the pair of members in which the distance between the pair of members about which the band wraps can be adjusted by movement of pair of members. This configuration of the projectile launcher can afford the advantage of allowing adjustment of the angle of the medial portion of the band which passes between the pair of member in the stretched condition of the band allowing fine adjustment of the force vectors which can act on the projectile as the band returns toward the unstretched condition.

Naturally, further objects of the invention are disclosed throughout other areas of the specification, drawings, photographs, and claims.

IV. BRIEF DESCRIPTION OF THE DRAWINGS

V. DETAILED DESCRIPTION OF THE INVENTION

Figure 1:
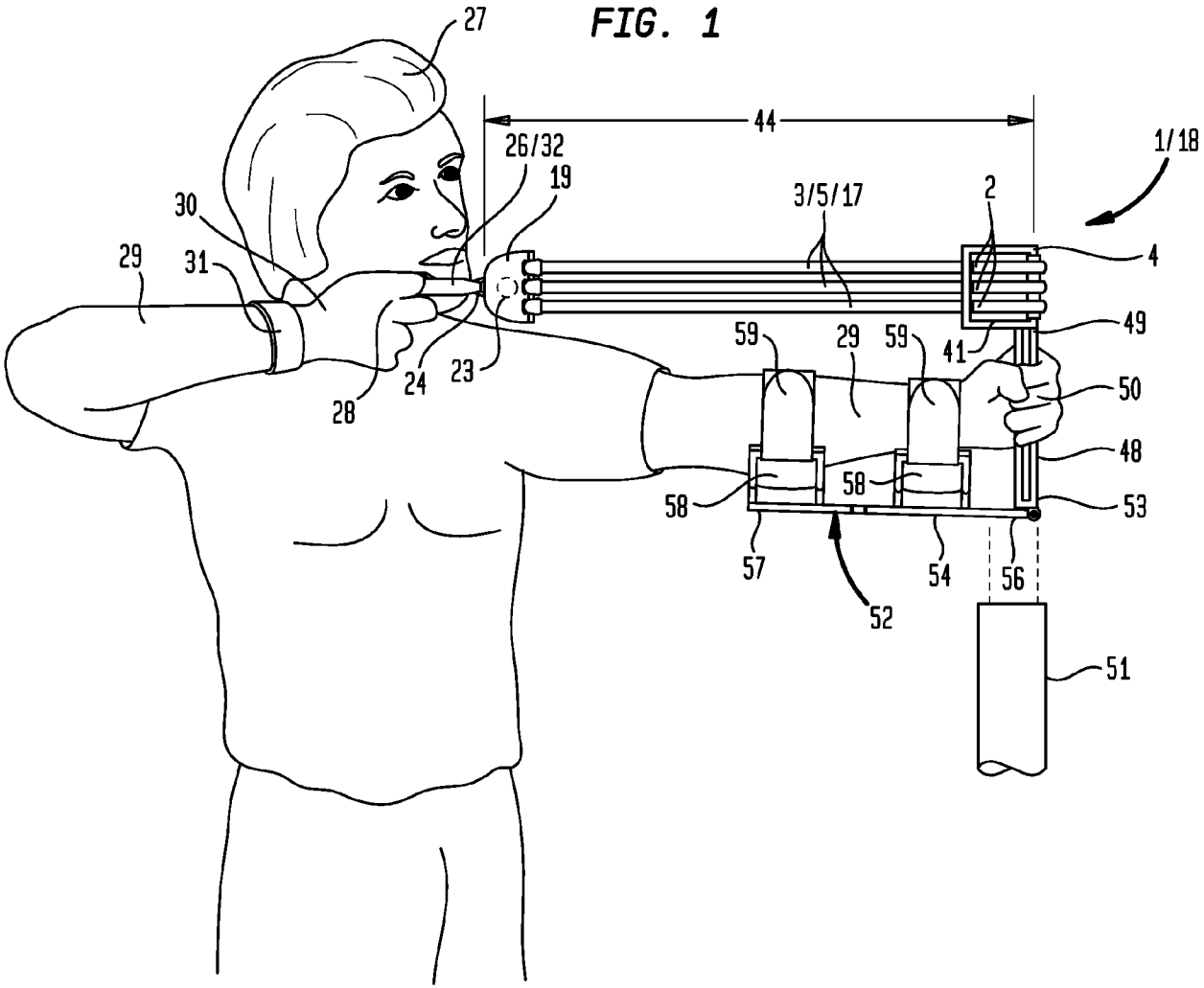
FIG. 1 is an illustration of a particular embodiment of the inventive projectile launcher in the drawn condition with the pouch retaining a projectile.

Now referring generally to FIGS. 1 through 10, embodiments of an inventive projectile launcher (1) can include a pair of band securement elements (2) each configured to secure a band (3), and a pair of members (4) correspondingly disposed in fixed relation a distance (5) from the pair of band securement elements (2) which permits the band (3) secured to the pair of band securement elements (2) to wrap about each of the pair of members (4) to allow a medial portion (5) of the band (3) to pass between the pair of members (4).

Figures 3, 3A:
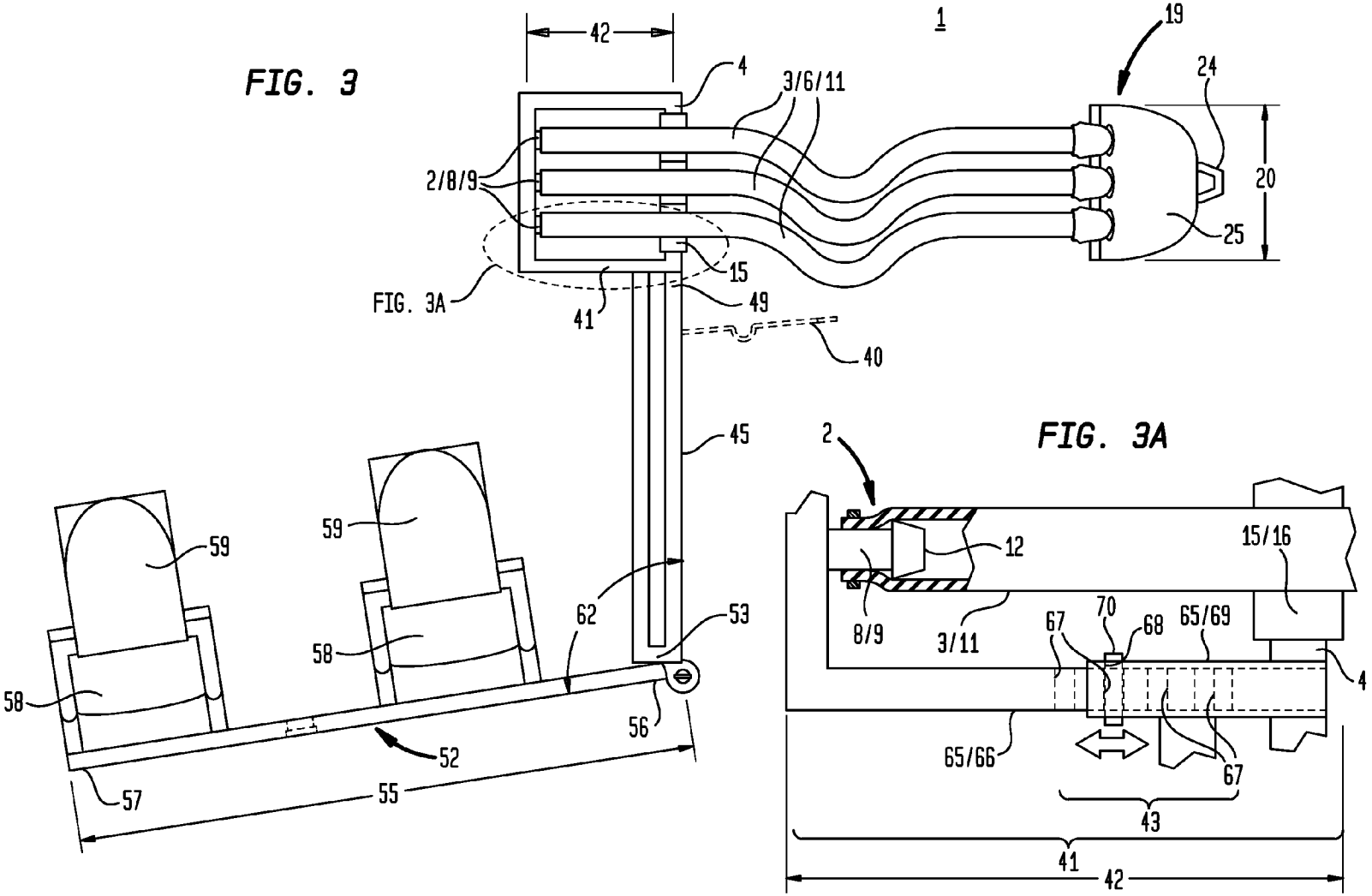
FIG. 3 is a side view of a particular embodiment of the inventive projectile launcher.
FIG. 3A is an enlargement of a portion of the particular embodiment of the inventive projectile launcher shown in FIG. 3.

Now referring primarily to FIGS. 3 through 7, the band (3) can have a numerous and wide variety of band configurations which can, but does not necessarily include, one or more of: solid bands having a generally circular or square cross section, flat bands having a generally rectangular cross section, tubular bands having an annular cross section, or combinations thereof. As shown in the illustrative example of FIGS. 3 through 7, a particular embodiment of the band (3) can be a tubular band (11) having a generally circular annular cross section. The band (3) can be produced from an elastic material capable upon being stretched of returning toward the original unstretched condition (6), and without limitation to the breadth of the forgoing, the elastic material can be one or more of natural rubber, cis-1,4-polyisoprene, trans-1,4-polyisoprene, synthetic rubber, isoprene rubber, polybutadiene, chloroprne, butyl rubber, nitrile rubber, natural latex, synthetic latex, thermoplastic elastomers, or combinations thereof. The term "band" for the purposes of this invention means one or more bands (3) and the term "a plurality of bands" means two or more bands (as an example three bands are shown in the example of FIG. 3).

Now referring primarily to FIG. 3, the pair of band securement elements (2) can be configured to secure the band (3), typically, but not necessarily, proximate the band ends (7). The pair of band securement elements (2) can have a numerous and wide variety of configurations to secure a corresponding numerous and wide variety of configurations of band ends (7). As shown in the example of FIG. 3, the pair of band securement elements (2) can be configured as a pair of posts (8) having a generally circular cross section and a post external surface (9) configured to engage an internal annular surface (10) of a tubular band (11). The pair of posts (8) can further include one or more band retaining elements (12) such as annular barbs, enlarged post ends, or other pattern surface elements configured to retain the band (3) in fixed relation to the pair of posts (8). The term "pair of band securement elements (2)" for the purposes of this invention means one or more pairs of band securement elements (2) and the term a plurality of pairs of band securement elements means two or more pairs of band securement elements configured to secure a plurality of bands (7) (as shown in the example of FIGS. 3 and 4, three pairs of band securement elements (2) secure a corresponding three bands (3)).

Figure 9A:
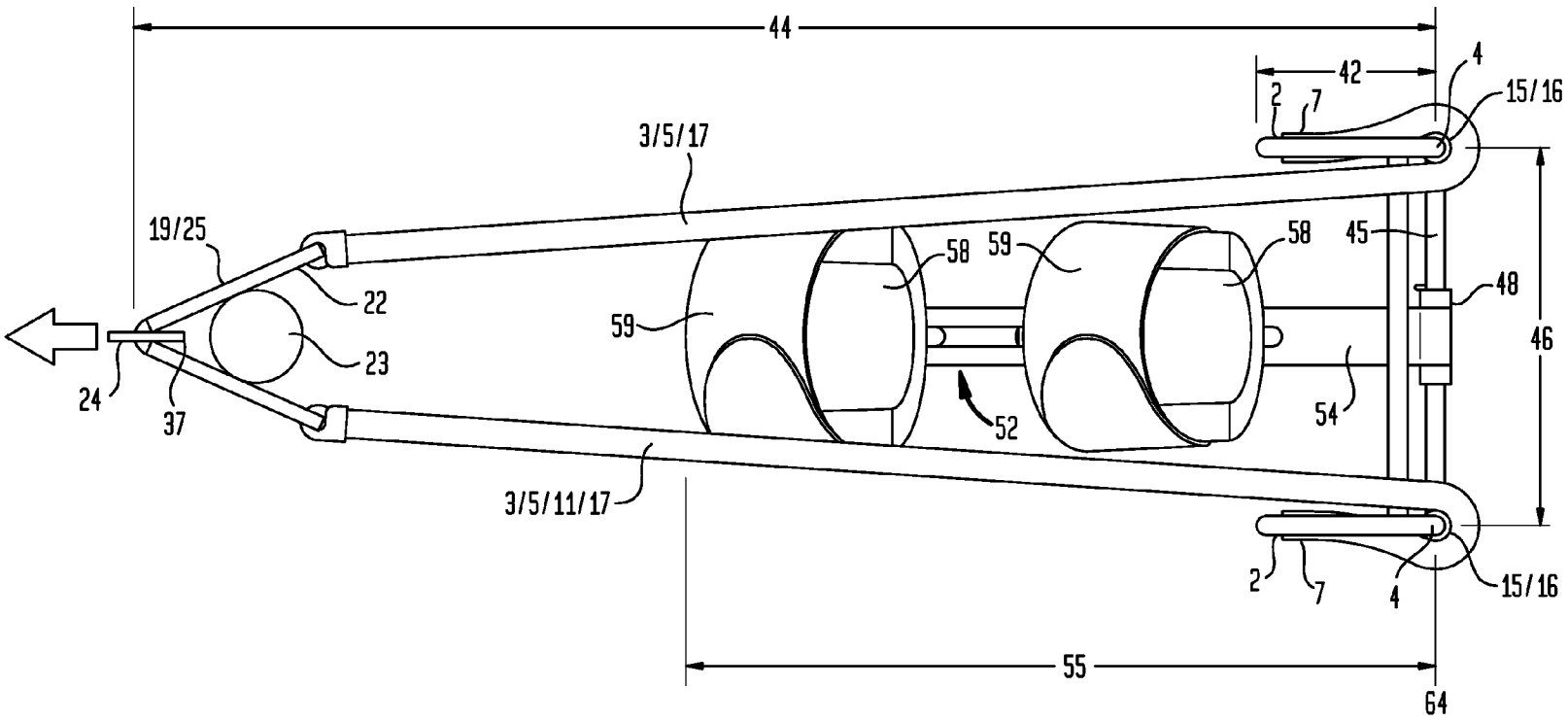
FIG. 9A is top view of a particular embodiment of the inventive projectile launcher which shows the bands wrapped about the pair of members to dispose the medial portion of the bands between the pair of members in the stretched condition with a pouch containing a projectile.
Figure 9B:
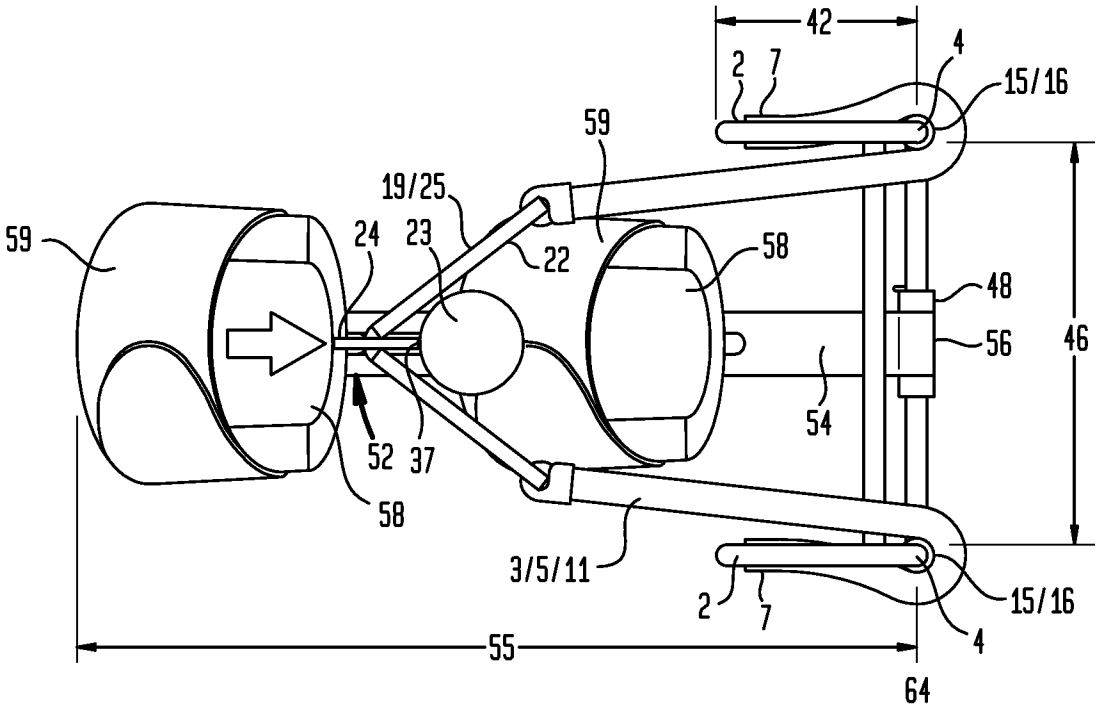
FIG. 9B is a top view of the particular embodiment of the inventive projectile launcher which shows the bands returning toward the unstretched condition to accelerate the projectile.

Now referring primarily to FIGS. 3, 4 and 9A through 9C, the pair of members (4) and the pair of band securement elements (2) can be disposed in fixed spatial relation which permits the band (3) secured to the pair of securement elements (2) to wrap about each of the pair of members (4) to allow a medial portion (5) of the band (3) to pass between the pair of members (4) (as shown in the examples of FIGS. 9A and 9B). As to particular embodiments, the pair of members (4) can be substantially linear solid or tubular members having a generally circular or circular annular cross section. However, this illustrative example is not intended to preclude embodiments in which the pair of members (4) are not linear or are not circular in cross section, and particular embodiments may have a pair of members (4) which along the member length (14) whether in whole or in part are arcuate, indented, recessed or the like to aid in guiding the band (3) upon being stretched or upon returning toward the original unstretched condition (6). Additionally, the cross sectional configuration along the member length (14) can be circular, oval, rectangular, square, triangular, or combinations thereof or other configuration which allows the band (3) to wrap about each of the pair of members (4) to allow the medial portion (5) of the band (3) to pass between the pair of members (4).

Figure 2:
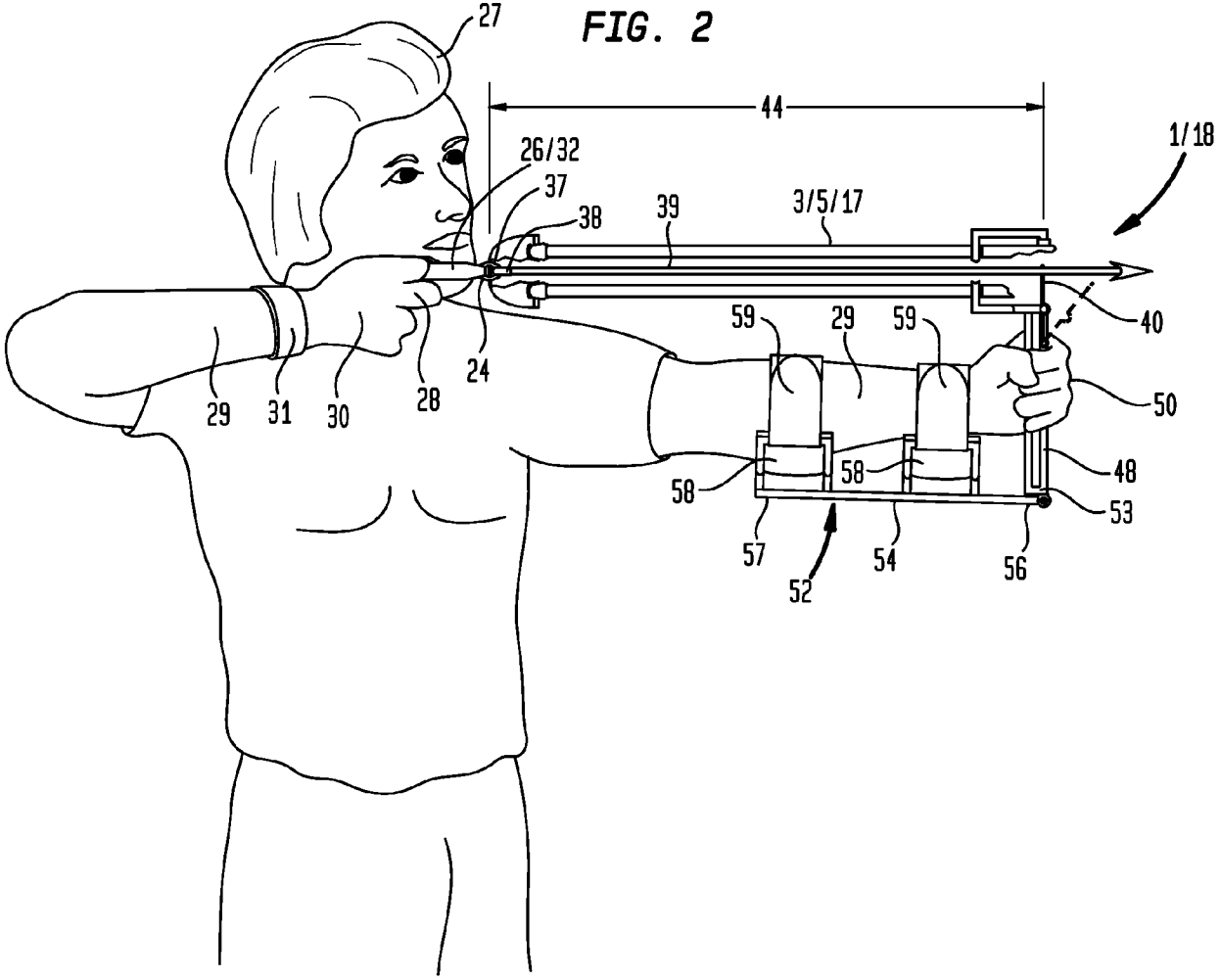
FIG. 2 is an illustration of a particular embodiment of the inventive projectile launcher in the drawn condition with the pouch retaining a projectile in the form of an arrow.

Again referring primarily to FIG. 3, embodiments of the projectile launcher (1) can further include a pair of bearings (15) correspondingly rotationally journaled to the pair of members (4). Each of the pair of bearings (15) can have a bearing external surface (16) configured to permit the band (3) secured to the pair of securement elements (4) to wrap about the bearing external surface (15) of each of the pair of bearings (15) to allow the medial portion (5) of the band (3) to pass between the pair of members (4). The pair of bearings (15) can rotate about the corresponding pair of members (4) during engagement of the band (3) with the bearing external surface (16) (whether wrapping engagement of the band (3) to dispose the medial portion (5) of the band (3) between the pair of members (4) (as shown in the example of FIG. 9A), or in generating the stretched condition (17) of the band (3) (as shown in the example of 9A) in the drawn condition (18) of the inventive projectile launcher (1) (as shown in the examples of FIGS. 1 and 2), or in return of the band (3) toward the unstretched condition (6) (as shown in the example of FIG. 9B)). The pair of bearings (15) can take a variety of forms including a bearing tube (as shown in the example of FIG. 3) with or without roller bearings, a roller bearing, a rolling element bearing, or other bearing structure capable of rotating about the pair of members (4) upon engagement of the band (3). The term "pair of bearings (15)" for the purpose of this invention means one or more pairs of bearings and the term plurality of bearings means two or more pairs of bearings configured to correspondingly engage a plurality of bands (3) (as shown in the example of FIGS. 3 and 4, three bands (3) correspondingly engage three pairs of bearings (15)).

Figure 4:
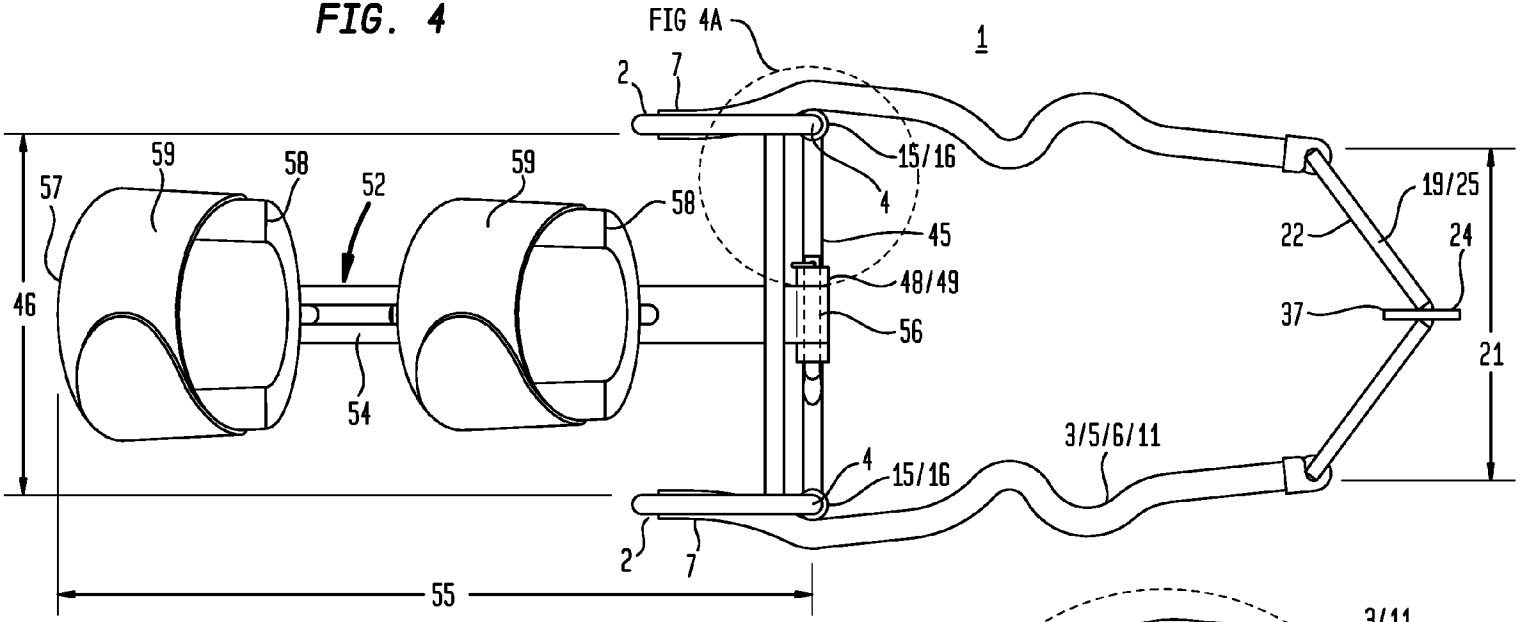
FIG. 4 is a top view of a particular embodiment of the inventive projectile launcher.
Figures 6, 7, 8, 8A:
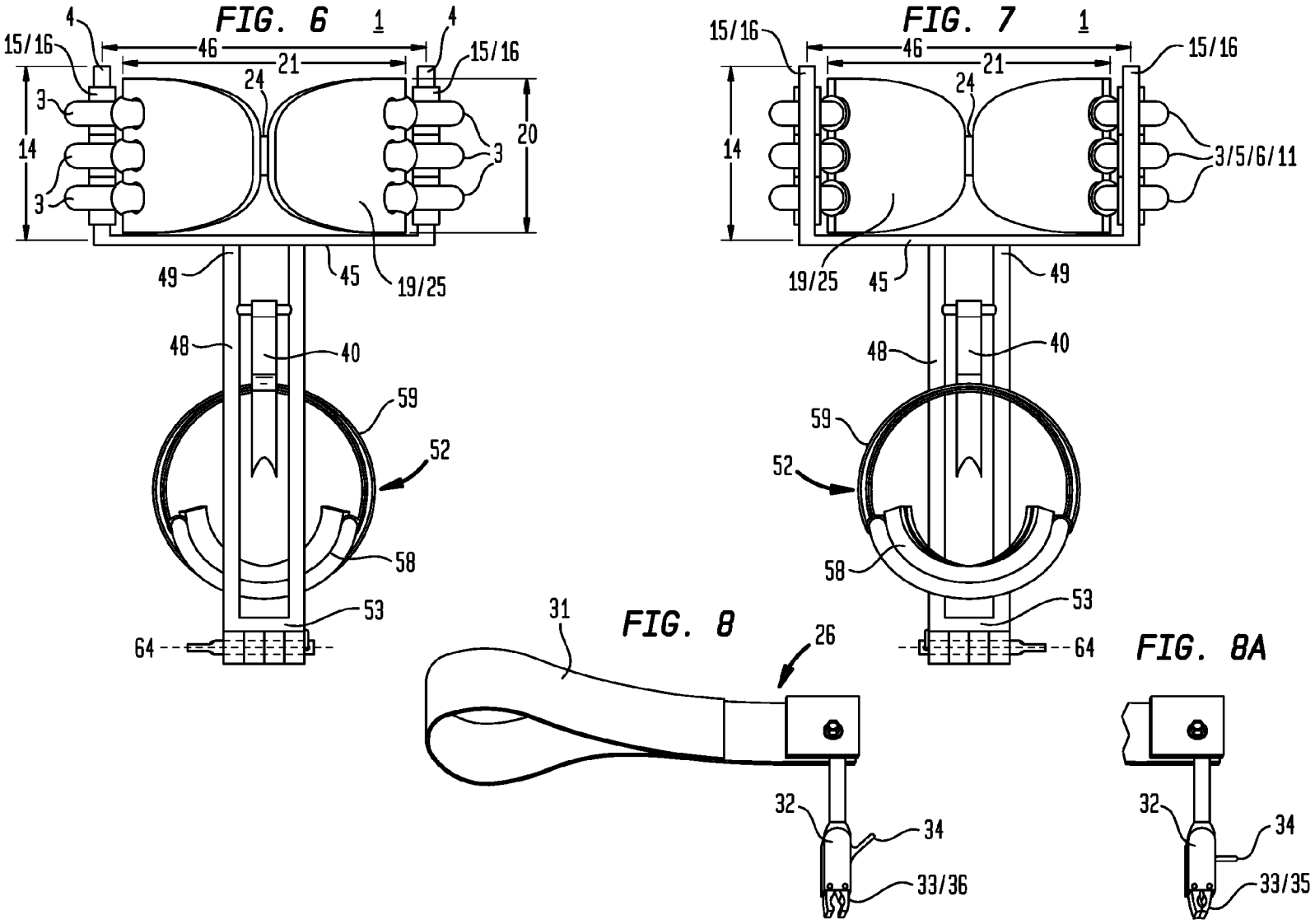
FIG. 6 is a front view of a particular embodiment of the inventive projectile launcher.
FIG. 7 is rear view of a particular embodiment of the inventive projectile launcher.
FIG. 8 is an illustration of a particular embodiment of a mechanical release with jaws in the open condition which can be used to with particular embodiments of the projectile launcher to place the projectile launcher in the drawn condition.
FIG. 8A is an illustration of a particular embodiment of a mechanical release with jaws in the closed condition which can be used to with particular embodiments of the projectile launcher to place the projectile launcher in the drawn condition.

Now referring primarily to FIGS. 1 and 4, embodiments of the projectile launcher (1) can further include a pouch (19) coupled to the medial portion (5) of the band (3). The pouch (19) can be made from a flexible material, typically, but not necessarily leather. The pouch (19) can configured to have a pouch width (20) and a pouch length (21) which provides a pouch internal surface (22). The pouch internal surface (22) can be configured to receive any one or more of a wide variety of projectiles (23) including one or more of: glass marbles, pellets, ball bearings, paint balls, buck shot, or the like (as shown in the examples of FIGS. 1 and 9A). As to particular embodiments, the pouch width (20) can be lesser approaching the center of the pouch (19) to aid in folding, conforming, or retaining the pouch (19) about the projectile (23). The pouch (19) can further include a pouch loop (24) extending from the pouch external surface (25). The pouch loop (25) can have a variety of configurations for releasable engagement of a corresponding variety of configurations of a mechanical release (26). The mechanical release (26) obviates direct engagement of the user (27) with the pouch (19) and can transfer the forces generated by pulling the bands (3) toward the drawn condition (18) from the user's fingers (28) typically, but not necessarily, to the user's arm (29) or wrist (30). One type of mechanical release (26) (as shown in the example of FIG. 8) includes a wrist band (31) which can be disposed about the user's wrist (30). A release element (32) can be coupled to the wrist band (31) can provide a pair of jaws (33) operable by a trigger (34) between a closed condition (35) and an open condition (36) (as shown in the example of FIG. 8). The pair of jaws (33) can be coupled in the closed condition (35) about the pouch loop (24) and released from the pouch loop (24) by operation of the trigger (34) to place the pair of jaws (33) in the open condition (36).

Now referring primarily to FIGS. 2 and 4, the pouch (19) can further include a nocking element (37) extending outward from the pouch internal surface (22). The nocking element (37) can be configured to matingly engage a nock (38) of an arrow (39) within the pouch (19). An arrow support (40) positionable between the pair of members (4) can support the arrow (39) with the nocking element (37) matingly engaged with the nock (38) of the arrow (39) (as shown in the example of FIG. 2).

Now referring primarily to FIGS. 3 and 3A, embodiments of the projectile launcher (1) can further include at least a pair of cross members (41) which correspondingly interconnect one of the pair of band securement elements (2) and one of said pair of members (4) to dispose each of the pair of members (4) at a distance (42) from each of the pair of band securement elements (2). As to particular embodiments, one or both of the pair of band securement elements (2) or one or both of the pair of members (4) can further include position adjustment element (43) which allows adjustable fixed engagement along one of the pair of cross members (41) to increase or decrease the distance (42) between one or both of the pair of band securement elements (2) and the corresponding one or both of the pair of members (4). As shown in the example of FIG. 3A, a particular embodiment of the cross member (41) includes telescoping mated cross member elements (65) with an inner telescopic cross member (66) having a plurality of bores (67) each telescopingly alignable with a pin bore (68) in the outer telescopic member (69) to allow removable insertion of a pin (70) to provide adjustable fixed engagement to increase or decrease the distance (42) between one or both of the pair of band securement elements (2) and the corresponding one or both of the pair of members (4). The illustrative example of FIG. 3A, is not intended to limit the position adjustment element (43) to a particular embodiment but rather provide sufficient description of a person of ordinary skill to make and use a wide variety of configurations of position adjustment elements (43) capable of provide adjustable fixed engagement to increase or decrease the distance (42) between one or both of the pair of band securement elements (2) and the corresponding one or both of the pair of members (4).

Positional adjustment of one or both of the pair of band securement elements (2) in fixed spatial relation to one or both of the pair of members (4) correspondingly allows adjustment of a variety of related features of the projectile launcher (1). A first advantage of increasing the distance (42) between the pair of band securement elements (2) and the pair of members (3) can be increased length of the band (3) that can be used with the projectile launcher (1) without a corresponding increase in the draw length (44) of the band (3) (as shown in the examples of FIGS. 1 and 2). A second advantage of increasing and decreasing the distance can be adjustment of the length of the medial portion (5) of the band (3) which passes between the pair of members (4) to correspondingly allow adjustment of draw length (44) of the band (3) between a plurality of different users (27) while maintaining substantially similar amount of draw weight of the band (3) in the drawn condition (18). A third advantage of increasing and decreasing the distance can be adjustment of the length of the medial portion (5) of the band (3) which passes between the pair of members (4) while maintaining consistent the draw length (44) to correspondingly allow adjustment of the amount of draw weight within the band (3).

Figure 4A:
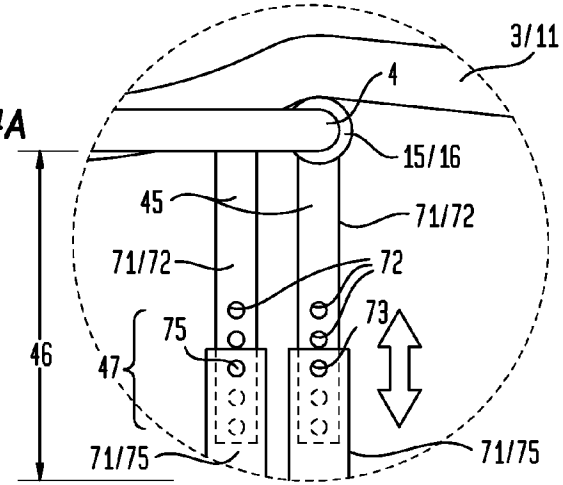
FIG. 4A is an enlargement of a portion of the particular embodiment of the inventive projectile launcher shown in FIG. 4.
Figure 5:
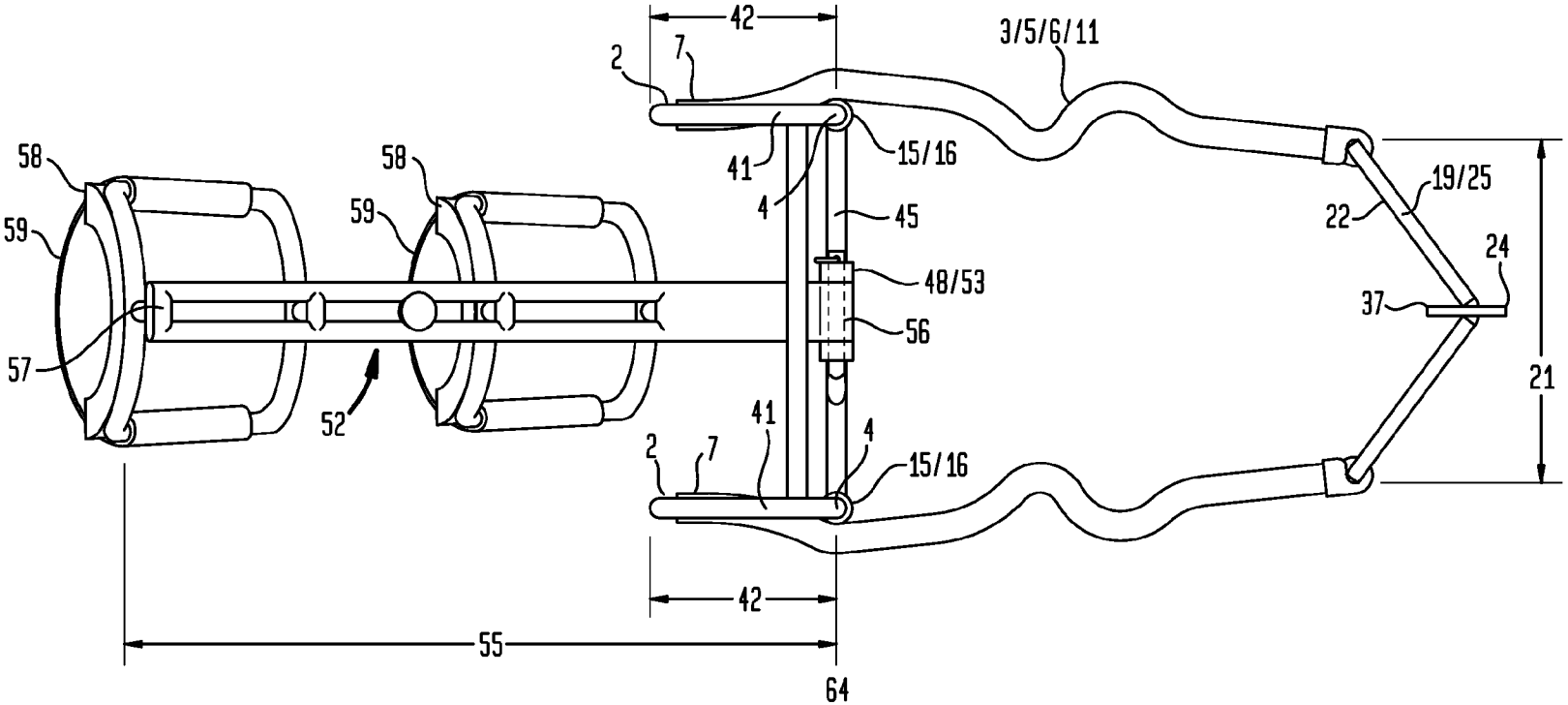
FIG. 5 is a bottom view of a particular embodiment of the inventive projectile launcher.

Now referring primarily to FIGS. 4, 4A, 6 and 7, embodiments of the projectile launcher (1) can further include a cross piece (45) which interconnects the pair of cross members (41) to locate the pair of cross members (41) in fixed spatial relation a distance (46) apart to permit the band (3) secured to the pair of band securement elements (2) to wrap about each of the pair of members (4) to allow a medial portion (5) of the band (3) to pass between the pair of members (4). As to particular embodiments, one or both of the pair of cross members (41) or the crosspiece (45) (the particular embodiment shown including a pair of rods) can further include cross member position adjustment element (47) which allows adjustable fixed engagement along the cross piece (45) to increase or decrease the distance (46) between the pair of cross members (41) and the correspondingly connected pair of members (4). As shown in the example of FIG. 4A, a particular embodiment of the cross piece (45) includes telescoping mated cross piece elements (70) with an inner telescopic cross piece (71) having a plurality of bores (72) each telescopingly alignable with a pin bore (73) in the outer telescopic cross piece (74) to allow removable insertion of a pin (75) to provide adjustable fixed engagement to increase or decrease the distance (46) between the pair of members (4).

Positional adjustment to increase or decrease the distance (46) between the pair of members (4) correspondingly allows adjustment of a variety of related features of the projectile launcher (1). A first advantage of increasing or decreasing the distance (46) between the pair of members (4) can be fine adjustment of the length of the band (3) that can be used with the projectile launcher (1) without a corresponding increase in the draw length (44) of the band (3) (as shown in the examples of FIGS. 1 and 2). A second advantage of increasing and decreasing the distance (46) can be fine adjustment of the draw length (44) of the medial portion (5) of the band (3) which passes between the pair of members (4) to correspondingly allow adjustment of draw length (44) of the band (3) between a plurality of different users (27) while maintaining substantially similar amount of draw weigh of the band (3). A third advantage of increasing and decreasing the distance (46) between the pair of members (4) can be fine adjustment of the force vectors which can act on the projectile (23) in the drawn condition (18) of the band (3) (as shown in the examples of FIGS. 1 and 2) and act on the projectile (23) upon release of the pouch (19).

Again referring primarily to FIGS. 6 and 7, embodiments of the projectile launcher (1) can further include a grip element (48) having a grip first end (49) coupled to the cross piece (45) (the particular embodiment shown in the example including a pair of rods). Typically, but not necessarily, the grip element (48) will be configured for gripping engagement of the user's hand (50) (as shown in the example of FIGS. 1 and 2); however, the grip element (50) can be configured to mate with projectile launcher support (51) which maintains the projectile launcher (1) in fixed position which allows the user (27) to grip the pouch (19) and place the band (3) in the drawn condition (18). As to particular embodiments, the grip element (48) can be configured as a plurality of solid rods interconnected as a unitary structure (as shown in the examples of FIGS. 3, 6 and 7); however, this is not intended to necessarily limit the configuration of the grip element (48) to this illustrative example. Rather, the grip element (48) can have any configuration which allows the user (27) to maintain the projectile launcher (1) in a fixed position (whether directly by gripping engagement of the user's hand (50) or mating engagement of the grip element (48) with a projectile launcher support (51).

Now referring primarily to FIGS. 1 through 7, particular embodiments of the projectile launcher (1) can further include an arm brace (52) coupled to the grip second end (53). The arm brace (52) coupled to the grip second end (53) can have a configuration which engages the user's arm (29) in a manner which allows the user (27) to grippingly engage the grip element (48) at a location between the grip first end (49) and the grip second end (53) allowing the user (27) to operate the projectile launcher (1). As to particular embodiments, the arm brace (52) includes a brace member (54) having a brace member length (55) disposed between a brace member first end (56) and a brace member second end (57). One or more arm brace pads (58) configured to engage the user's forearm (29) can be coupled to the brace member (54). As to particular embodiments, the brace member (54) and brace pads (58) can be configured to be positionally engaged beneath user's forearm (29) when the user (27) grippingly engages the grip element (48). One or more straps (59) coupled in fixed relation to the brace member (54) can releasably secure about the user's forearm (29) to fix the location of the arm brace (52) in relation to the user's forearm (29). The forces opposing the stretched condition (17) of the band (3) can be transferred in part from the user's hand (50) and wrist (30) to the user's forearm (29). Understandably, the arm brace (50) can take other configurations. As one alternate example, the arm brace (50) can extend from the grip element (48) over the user's wrist (30) to be located over the user's forearm (29) to counter the forces generated by stretched condition (17) the bands (3).

Figure 10:
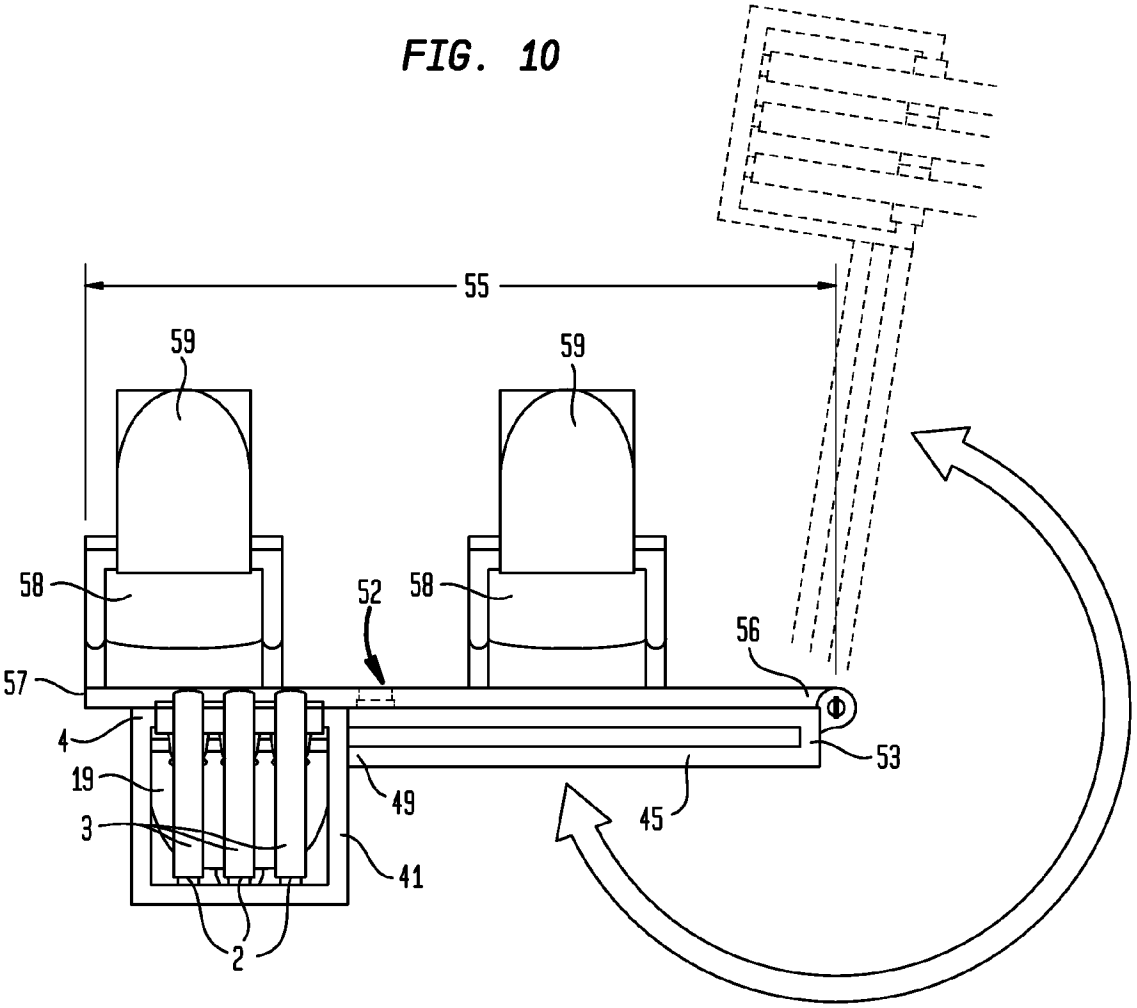
FIG. 10 is a side view of a particular embodiment of the inventive projectile launcher in which the arm brace rotates about the grip second end to a folded condition in which the arm brace lies adjacent the grip element.

Now referring primarily to FIGS. 6, 7 and 10, as to particular embodiments of the arm brace first end (56) can be rotationally coupled to the grip element (48). The arm brace (52) can be rotated about the rotational axis (64) (as shown in the example of FIG. 10) to dispose the projectile launcher (1) between a folded condition (60) (as shown in the examples of FIGS. 6 and 7) and an operable condition (61) (as shown in the example of FIG. 3). In the folded condition (60) the arm brace (52) has a position adjacent the grip element (48) and in the operable condition (61) the arm brace (52) can be maintained in fixed angled relation to the grip element (48). As to particular embodiments, the angle (62) formed in the operable condition (61) by the arm brace (52) in fixed angle relation to the grip can be in the range of about 90° and about 150°.

Now referring primarily to FIGS. 1, 2, 9A through 9C and 10 which show the operation of an illustrative embodiment of the inventive projectile launcher (1). As shown in FIGS. 1 and 2, embodiments of the grip element (48) can be grippingly engaged by the user's hand (50). As to particular embodiments, an arm brace (52) coupled to the grip second end (53) can be secured to the user's forearm (29) (as shown in the example of FIGS. 1 and 2). As to embodiments which can be disposed in the folded condition (60) (as shown in the example of FIG. 10), the arm brace (52) can be rotated about the rotation axis (64) toward the operational condition (61) (as shown in the examples of FIGS. 1 and 2). As to certain embodiments, the grip element (48) can be coupled in releasably fixed relation to a launcher support (51) (as shown in the example of FIG. 1).

As shown in FIG. 9A, a projectile (23) can be positioned within the pouch (19). As to particular embodiments, the nock (38) of an arrow (39) can be matingly engaged with the nocking element (37) and the arrow support (40) can be positioned between the pair of members (4). The arrow (39) can be supported by the arrow support (40) with the nocking element (37) matingly engaged with the nock (38) of the arrow (39) (as shown in the example of FIG. 2). As to particular embodiments of the projectile launcher (1), the pouch (19) can be gripped by the user's fingers (28), or a mechanical release (26) (as shown for example in FIG. 8) can be secured to the user's forearm (29) or wrist (30) and coupled to the pouch loop (24) (as shown the examples of FIGS. 1 and 2).

Now referring primarily to FIG. 9A, the band (3) (which can be a plurality of bands as shown in the example of FIG. 3) secured to the corresponding pair of band securement elements (2) can be wrapped about each of the pair of members (4) to allow a medial portion (5) of the band (3) to pass between the pair of members (4). As to those embodiments, which further include a pair of bearings (15) correspondingly rotatably coupled about the pair of members (4) (which can be a plurality of bearings as shown in the example of FIG. 3) the band (3) (or plurality of bands) can be wrapped about the bearing external surface (16) to allow the medial portion (5) of the band (3) to pass between the pair of members (4).

Figure 9C:
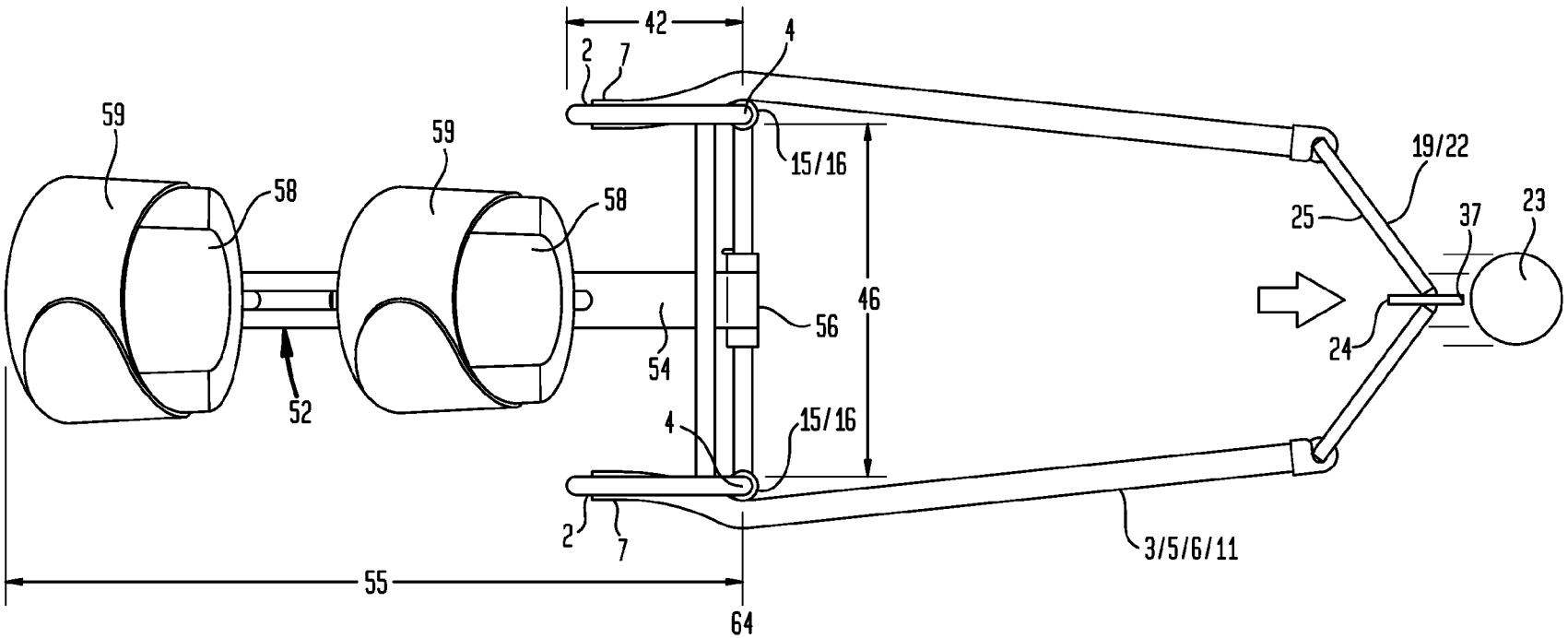
FIG. 9C is a top view of the particular embodiment of the inventive projectile launcher which shows the bands unwrapped from the pair of members and in the unstretched condition releasing the projectile.

Again referring primarily to FIGS. 1, 2 and 9A, the band (3) can stretched in the drawn condition (18) of the projectile launcher (1) (as shown in the example of FIG. 9A). The pouch (19) can be released from the drawn condition (18) of the projectile launcher (1) and can pass between the pair of members (4) as the band (3) returns toward the unstretched condition (6) (as shown in the example of FIGS. 9B and 9C). In returning toward the unstretched condition (6), the band (3) unwraps from the pair of members (4), or from the bearing external surface (16) of the pair of bearings (15), depending upon the embodiment (as shown in the example of 9C). The bands (3) unwrapping from about the pair of members (4), or unwrapping from about the bearing external surface (16) of the pair of bearings (15), upon returning to toward the unstretched condition (6) provides a substantial advantage in that the band (3) does not have to fold upon, overlay, or have the band external surface (63) disposed in adjacent relation to allow the pouch (19) to pass between the pair of members (4) in release of the projectile (23). Avoiding folding, overlaying or having to dispose the band external surface (63) in adjacent relation, allows greater and more uniform transfer of forces from the band (3) to the projectile (23) as the band (3) returns toward the unstretched condition (6).

Now referring primarily to FIG. 10, the projectile launcher (1) can be returned to the folded condition (60) by releasing the arm brace (52) (if any) from the user's forearm (29) and disengagement of the user's hand (50) from the grip element (48). The arm brace (52) can be rotated about the rotation axis (64) of the grip second end (53) to dispose the arm brace (52) in adjacent relation to the grip element (48).

As can be easily understood from the foregoing, the basic concepts of the present invention may be embodied in a variety of ways. The invention involves numerous and varied embodiments of a projectile launcher and methods for making and using such projectile launcher including the best mode.

As such, the particular embodiments or elements of the invention disclosed by the description or shown in the figures or tables accompanying this application are not intended to be limiting, but rather exemplary of the numerous and varied embodiments generically encompassed by the invention or equivalents encompassed with respect to any particular element thereof. In addition, the specific description of a single embodiment or element of the invention may not explicitly describe all embodiments or elements possible; many alternatives are implicitly disclosed by the description and figures.

It should be understood that each element of an apparatus or each step of a method may be described by an apparatus term or method term. Such terms can be substituted where desired to make explicit the implicitly broad coverage to which this invention is entitled. As but one example, it should be understood that all steps of a method may be disclosed as an action, a means for taking that action, or as an element which causes that action. Similarly, each element of an apparatus may be disclosed as the physical element or the action which that physical element facilitates. As but one example, the disclosure of a "grip" should be understood to encompass disclosure of the act of "gripping"—whether explicitly discussed or not—and, conversely, were there effectively disclosure of the act of "gripping", such a disclosure should be understood to encompass disclosure of a "grip" and even a "means for gripping." Such alternative terms for each element or step are to be understood to be explicitly included in the description.

In addition, as to each term used it should be understood that unless its utilization in this application is inconsistent with such interpretation, common dictionary definitions should be understood to included in the description for each term as contained in the Random House Webster's Unabridged Dictionary, second edition, each definition hereby incorporated by reference.

All numeric values herein are assumed to be modified by the term "about", whether or not explicitly indicated. For the purposes of the present invention, ranges may be expressed as from "about" one particular value to "about" another particular value. When such a range is expressed, another embodiment includes from the one particular value to the other particular value. The recitation of numerical ranges by endpoints includes all the numeric values subsumed within that range. A numerical range of one to five includes for example the numeric values 1, 1.5, 2, 2.75, 3, 3.80, 4, 5, and so forth. It will be further understood that the endpoints of each of the ranges are significant both in relation to the other endpoint, and independently of the other endpoint. When a value is expressed as an approximation by use of the antecedent "about," it will be understood that the particular value forms another embodiment. The term "about" generally refers to a range of numeric values that one of skill in the art would consider equivalent to the recited numeric value or having the same function or result. Similarly, the antecedent "substantially" means largely, but not wholly, the same form, manner or degree and the particular element will have a range of configurations as a person of ordinary skill in the art would consider as having the same function or result. When a particular element is expressed as an approximation by use of the antecedent "substantially," it will be understood that the particular element forms another embodiment.

Moreover, for the purposes of the present invention, the term "a" or "an" entity refers to one or more of that entity unless otherwise limited. As such, the terms "a" or "an", "one or more" and "at least one" can be used interchangeably herein.

Thus, the applicant(s) should be understood to claim at least: i) each of the projectile launchers herein disclosed and described, ii) the related methods disclosed and described, iii) similar, equivalent, and even implicit variations of each of these devices and methods, iv) those alternative embodiments which accomplish each of the functions shown, disclosed, or described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) methods and apparatuses substantially as described hereinbefore and with reference to any of the accompanying examples, x) the various combinations and permutations of each of the previous elements disclosed.

The background section of this patent application provides a statement of the field of endeavor to which the invention pertains. This section may also incorporate or contain paraphrasing of certain United States patents, patent applications, publications, or subject matter of the claimed invention useful in relating information, problems, or concerns about the state of technology to which the invention is drawn toward. It is not intended that any United States patent, patent application, publication, statement or other information cited or incorporated herein be interpreted, construed or deemed to be admitted as prior art with respect to the invention.

The claims set forth in this specification, if any, are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent application or continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

Additionally, the claims set forth in this specification, if any, are further intended to describe the metes and bounds of a limited number of the preferred embodiments of the invention and are not to be construed as the broadest embodiment of the invention or a complete listing of embodiments of the invention that may be claimed. The applicant does not waive any right to develop further claims based upon the description set forth above as a part of any continuation, division, or continuation-in-part, or similar application.

I claim:

1. A hand held projectile launcher, comprising:

at least two pairs of band securement elements configured to correspondingly secure at least two bands;

a pair of members defining a pair of member axes disposed in fixed relation a distance from said at least two pairs of band securement elements; and at least two pairs of bearings discretely rotating about said pair of members axes of said pair of members, said at least two bands wrapping correspondingly about said at least two pairs of bearings to pass a medial portion of each of said at least two bands between said pair members, each of said at least two pairs of bearings discretely rotationally responsive to one of said at least two bands.

2. The hand held projectile launcher of claim 1, further comprising a pouch coupled to said medial portion of said at least two bands.

3. The hand held projectile launcher of claim 2, further comprising a knocking element connected to said pouch, said knocking element configured to matingly engage a nock of an arrow.

4. The hand held projectile launcher of claim 3, further comprising an arrow support rotatably positionable between said pair of members to support an arrow having said nocking element matingly engaged with said nock of said arrow.

5. The hand held projectile launcher of claim 1, further comprising a pair of cross members which correspondingly interconnect one of said pair of band securement elements and one of said pair of members to dispose each of said pair of members at said distance from each of said pair of band securement elements.

6. The hand held projectile launcher of claim 5, further comprising a position adjustment element connected to at least one of said pair of cross members between at least one of said pair of band securement elements of and at least one of said a pair of members to allow adjustable fixed engagement of said at least one of said pair of band securement elements or said at least one of said a pair of members along at least one of said pair of cross members.

7. The hand held projectile launcher of claim 6, further comprising a cross piece which interconnects said pair of cross members.

8. The hand held projectile launcher of claim 7, further comprising a cross member position adjustment element connected to said cross piece between said pair of cross members to allow adjustable fixed engagement of said at least one of said pair of cross members along said cross piece.

9. The hand held projectile launcher of claim 8, further comprising a grip element coupled to said cross piece.

10. The hand held projectile launcher of claim 9, further comprising an arm brace coupled to said grip element, said arm brace configured to engage a user's forearm at a location which allows gripping engagement of said grip element by said user to operate said projectile launcher.

11. The hand held projectile launcher of claim 10, wherein said arm brace rotationally couples to said grip element, said projectile launcher disposed by rotation of said arm brace between a folded condition in which said arm brace lies adjacent said grip element and an operable condition in which said arm brace is disposed in fixed angle relation to said grip element.

12. The hand held projectile launcher of claim 1, wherein said plurality of pairs of bands comprise tubular bands.

* * * * *